United States Patent [19]

Tasler et al.

[11] Patent Number: 4,852,370

[45] Date of Patent: Aug. 1, 1989

[54] WARP-KNITTING MACHINE, PARTICULARLY STITCH KNITTING MACHINE

[75] Inventors: Guenter Tasler, Klaffenbach; Klaus Wiendenhoeft; Michael Schultheiss, both of Karl Marx Stadt; Martin Schoenfuss, Hohenstein-Ernstthal; Theo Ludwig, Karl Marx Stadt; Klaus Huster, Karl Marx Stadt; Dietmar Grenzendoerfer, Karl Marx Stadt, all of German Democratic Rep.

[73] Assignee: VEB Kombinat Textima, Karl Marx Stadt, German Democratic Rep.

[21] Appl. No.: 239,723

[22] Filed: Sep. 1, 1988

[30] Foreign Application Priority Data

Oct. 9, 1987 [DD] German Democratic Rep. ... 307778

[51] Int. Cl.[4] ..... D04B 23/00

[52] U.S. Cl. ..... 66/203; 66/84 A; 66/207; 66/208

[58] Field of Search ..... 66/84 A, 85 A, 203, 66/207, 208

[56] References Cited

U.S. PATENT DOCUMENTS

| | | | |
|---|---|---|---|
| 2,428,405 | 10/1947 | Young | 66/208 |
| 2,688,860 | 9/1954 | Lambach | 66/207 |
| 2,890,579 | 6/1959 | Mauersberger | 66/85 A |
| 3,310,964 | 3/1967 | Peschl et al. | 66/85 A |

FOREIGN PATENT DOCUMENTS

| | | | |
|---|---|---|---|
| 892689 | 3/1962 | United Kingdom | 66/203 |

*Primary Examiner*—Ronald Feldbaum
*Attorney, Agent, or Firm*—Jordan and Hamburg

[57] ABSTRACT

Warp knitting machine, in particular stitch-bonding machine, a drive for the operation of a row of knitting needles and at least one row of guide needles. The drive for the row of knitting needles and the drive for the performance of oscillatory motions of the row of guide needles are each connected with a separate drive shaft, and the drive shaft of the drive for the oscillatory motions is located under or behind the working plane of the row of knitting needles and before the finished goods and is furnished with a plurality of units of drive means, distributed over the working width of the machine, for the oscillatory motions.

10 Claims, 3 Drawing Sheets

WARP-KNITTING MACHINE, PARTICULARLY STITCH KNITTING MACHINE

Figure 1:
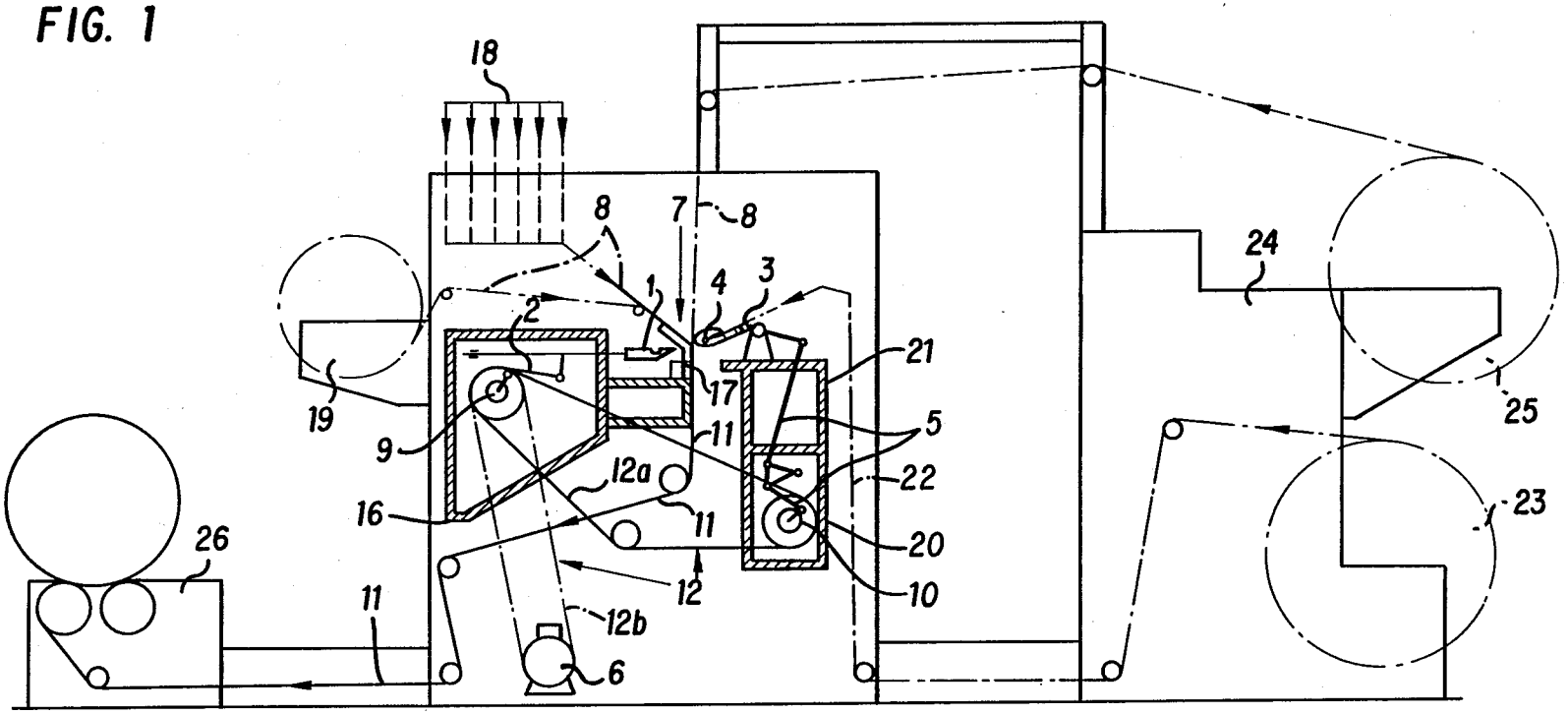

The invention relates to a warp knitting machine.

BACKGROUND OF THE INVENTION

Stitch-knitting or stitch-bonding machines are warp knitting machines by means of which basic materials or widths of basic materials, such as for example lays of thread, fleeces, textiles, warp-knitted fabrics, stitch-knitted fabrics and foils may be processed. For this purpose these machines have been provided over, between and under the rows of needles with a free space for passage of a basic material and the finished goods which extends the entire length of the rows of needles, so as to be able to feed the basic material undisturbed in the direction over the rows of needles and guide it through between the row of knitting needles and the row of guide needles, as well as to be able to remove the goods.

A machine of this kind has been disclosed wherein the drive means for the work tools, which include the drive means for the performance of the oscillatory motions of a guide bar provided with a row of guide needles, is located on a main shaft which is divided into a plurality of shaft parts separated from one another (DD 15,935 - Cl. 52a, 9/04). As is shown in U.S. Pat. No. 3,354,672, which likewise concerns a stitch-bonding machine, a supplement of the said source patent DD 15,935 which was not represented in the DD patent, on a stitch-bonding machine an oscillating shaft, on which is supported at least one guide bar with a row of guide needles, hitherto was necessarily always driven at its two outer ends outside the space for passage of a basic material. (FIG. 1 of the U.S. patent relates only to the left end of the oscillating shaft). Drive of the oscillating shaft was effected by means of a coupling rod, which on the one hand is connected articulated with a connecting rod (a part of the drive means of the work tools) and, on the other hand forms a joint with a lever. The joint was attached transverse to the longitudinal axis of the oscillating shaft on the same. Since the connecting rod, which in this case is driven from a universal main shaft, is capable of moving to and fro, the oscillating shaft performs partial reversing turns which, through the compound needles, impart an oscillatory motion to the row of guide needles.

As an essential characteristic of stitch-bonding machines, the free space for passage of a basic material renders it necessary to drive the oscillating shaft only at its two outer ends outside the pass-through space, because the necessity of the pass-through space is linked with the condition that any arrangement of machine elements in the region of the pass-through space, as known in other warp knitting machines with, for example, means for supporting and operating guide bars, must be eliminated. Machine elements in the pass-through space would interfere with the feed of basic material. In other warp knitting machines the warp yarns to be fed may be guided around or carried past operating means for guide bars. However, the described drive of an oscillating shaft properly sized to the space available in the stitch-bonding machine exhibits troublesome shortcomings. When work is done at a high rate of oscillation, the distorsions occurring in the oscillating shaft assume such large orders of magnitude that, especially in the center region of the row of guide needles, the top and bottom terminal positions of oscillation of the guide needles are considerably further removed from the working plane of the compound needles than was theoretically predicted for satisfactory operation.

This then results in failures in the cooperation of the compound needles, the guide needles and the yarns to be processed, which mahy lead to a complete breakdown of operability of the warp knitting machine. The longer the oscillating shaft provided or the greater the working width of the machine selected, the more intensive the reciprocal distorsions that appear, which are followed by correspondingly severe operating failures. An increase in diameter or a non-circular cross section of the oscillating shaft either fails to eliminate above drawbacks or creates other serious disadvantages. For example, such a distinct increase in diameter of the oscillating shaft, including an appropriate bearing, which ensures normal cooperation of the compound needles and guide needles at high rates of oscillation and a great working width, results in such a space requirement that operation of the machine is significantly hindered.

SUMMARY OF THE INVENTION

It is an object of the invention to eliminate the above disadvantages and to increase the reliability of operation of the machine, as well as to increase its production capacity.

Another object of the invention is to provide a warp knitting machine, particularly a stitch-bonding machine, which works at a high rate of oscillation of at least one row of guide needles, wherein the distorsions of the oscillating shaft hitherto occurring in alternating direction are eliminated, without adversely affecting the space for passage of the basic material and the finished goods or restricting the space for operation of the machine.

The object of the invention is accomplished in that the drive means for the operation of the row of knitting needles and the drive means for the performance of the oscillatory motions of the row of guide needles are each connected with a separate drive shaft. These drive shafts have a drive connection with the main drive of the machine and in each instance are arranged between the main drive and the appurtenant drive means. The drive shaft for the drive means for the performance of the oscillatory motions of the row of guide needles is located under and/or behind the working plane of the row of knitting needles and before the finished goods. The drive shaft for the drive means for the performance of the oscillatory motions of the row of guide needles is furnished with a plurality of drive means distributed across the working width of the machine.

The invention provides the advantage of the elimination of distorsions of the oscillating shaft, because the latter is now capable of being driven even at inner sections without encroaching upon the space for passage of the basic material and the finished goods or the space for operation of the machine. Increases in diameter of the oscillating shaft when machines are widened are no longer necessary.

BRIEF FIGURE DESCRIPTION

The invention will be explained in detail with the aid of several examples. The pertinent drawings show in FIG. 1: a schematic view of the warp knitting machine, FIG. 2: a perspective view of a variety of drive components of the machine, FIGS. 3 and 4: a gear scheme of drive means for the performance of oscillatory motions of the row of guide needles and a diagram of the relations of the path of the oscillatory motion to the rotation of the associated drive shaft, FIGS. 5 and 6 and FIGS. 7 and 8: the same as FIGS. 3 and 4, but with another gear design.

Pursuant to FIG. 1, a warp knitting machine is represented in a schematic side view as a stitch-bonding machine.

DISCLOSURE OF PREFERRED EMBODIMENT OF THE INVENTION

The machine is equipped with a row of knitting needles 1, preferably compound needles, which are movable forward and backward by directly assigned drive means 2. A known slide crank gear may be used as drive means 2. The hooks of the knitting needles 1 are lockable by slides, not shown. A slide crank gear may likewise be used for this. In addition, the machine contains at leat one guide bar 3 with a row of guide needles 4 which, for the purpose of carrying out oscillatory and displacing motions, are likewise in communication with immediately appurtenant drive devices in each instance, while drive means 5 are provided for the oscillatory motions. In one embodiment the drive means 5 may be coupled gears. Alternatively, cam gears may be employed as drive means 5. For the performance of the motions of displacement of the row of guide needles 4, an offset gear customary on warp knitting machines, which is equipped with, for example, pattern cam disks, chain links or a pick-off gear, may be used. The drive means 2 of the row of knitting needles 1 and the drive means 5 of the row of guide needles 4 are coupled with the main drive 6 of the machine.

In order to be able to feed a basic material 8 in the direction to pass over the row of needles 1,4 undisturbed and to guide it to pass between the row of knitting needles 1 and the row of guide needles 4, the machine has been provided, over, between and under the rows of needles 1,4 with a free pass-through space 7 which extends the entire length of the rows of needles 1,4.

Figure 2:
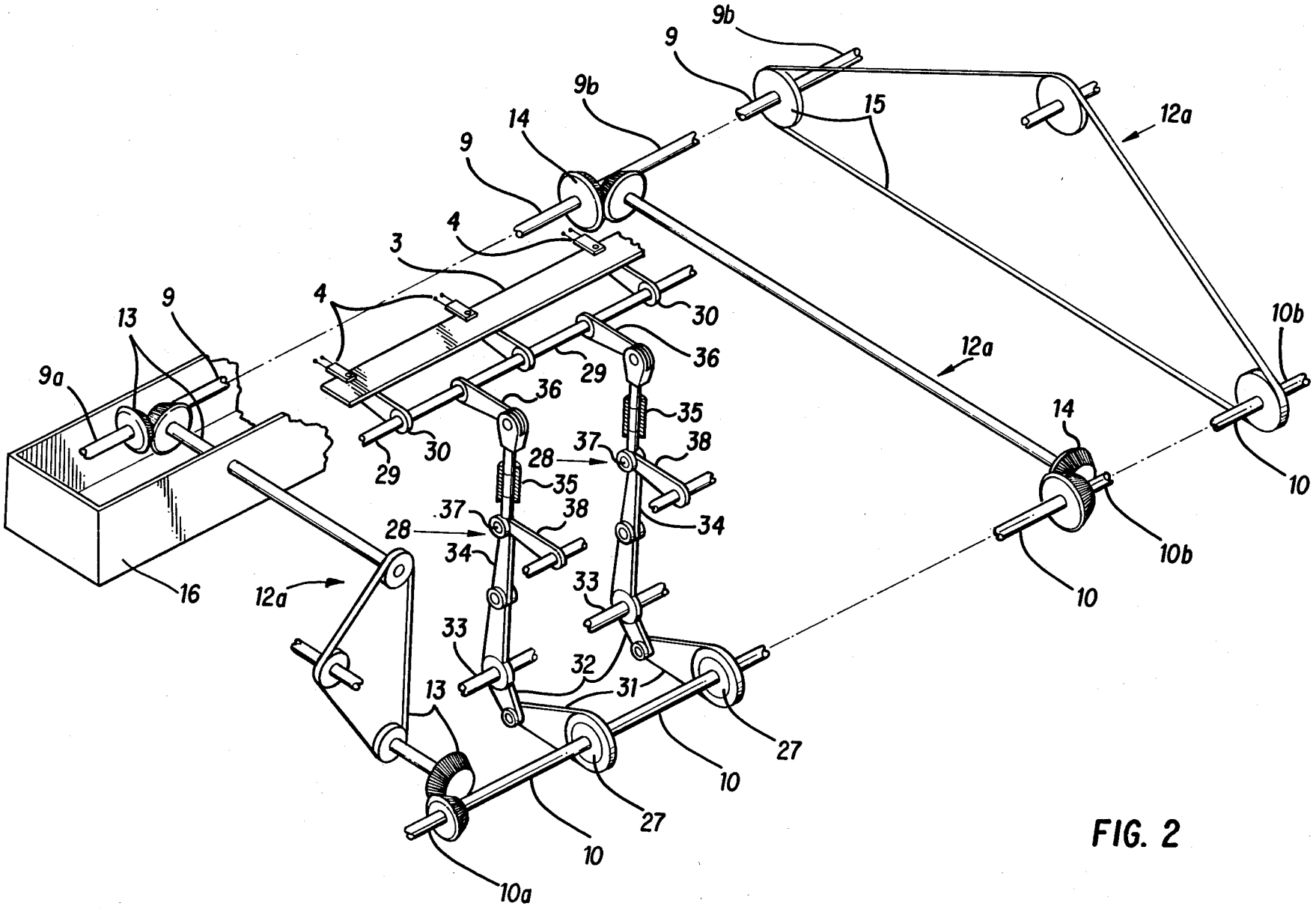

The drive means 2 of the row of knitting needles 1 and the drive means 5 of the row of guide needles 4 with the main drive 6 are intercoupled. Thus the direct drive means 2 for the operation of the row of knitting needles 1 and the direct drive means 5 for the performance of the oscillatory motion of the row of guide needles 4 are each connected with a separate drive shaft 9 and 10 respectively, which in turn are in a drive connection 12 with the main gear 6. The drive connection 12 may in one case be effected so that one drive shaft 9 drives the other shaft 10 by a drive unit 12*a*, designed essentially as a means of traction, and the driving shaft 9 is drive-connected with the main drive 6 by an additional drive unit (means of traction) 12*b*. In this arrangement the drive shafts 9,10 are each arranged between the appurtenant drive means 2,5 and the main drive 6. In this positional relationship the drive shaft 10 for the drive means 5 for the performance of the oscillatory motion of the row of guide needles 4 additionally is located under and/or behind the working plane of the row of knitting needles 1 and before the finished goods 11. In addition, the drive shaft 10 is furnished with a plurality of individual drive means 5 distributed across the working width of the machine. The drive shaft 9 is located in a closed gear case 16 in which the drive means 2 of row of the knitting needles 1 are alternatively contained. Knockover bar 17 is mounted in front of the gear case 16, and over and behind the gear case 16 are arranged feed device 18,19 from which basic materials 8 are introduced into the stitch-formation station. In this connection, by means of the device 18 transverse threads are laid and prepared as weft yarn layer. The device 19 comprises a package of a basic material 8 that may be a fleece or a width of some other basic material. Pursuant to FIG. 1, a closed gear case 20 has alternatively been provided for the drive shaft 10. The case is attached under a supporting element 21 for the guide bar 3. A chain of sewing threads (knitting threads) 22 for uniting the basic material 8, which may be composed of a plurality of layers or lays, is guided in front of the supporting element 21 and unrolled from a warp beam 23 which sits turning in a take-off frame 24. The basic material 8 may in addition alternatively contain a loose thread chain that is drawn off a warp beam 25. For winding up the finished goods 11 a winding device 26 is present behind the machine. According to the invention the drive connection 12 includes drive units 12 *a,b* which form the connection of the drive shafts 9,10 with one another and from the main drive 6. FIG. 2 shows, inter alia, different variants of how the drive unit 12 a may alternatively be designed. In a first modification the drive unit 12 a is a toothed-belt bevel gear drive 13. In addition, the possibility exists of using a bevel gear drive 14. Thirdly, a tooth-belt or a roller-chain drive 15 may be employed as drive unit 12*a*.

In an advantageous embodiment of the invention, a drive unit 12*a* of the same type is arranged at either side 9*a*, 10*a* and 9*b*, 10*b* of the drive shafts 9, 10, outside the pass-through space 7 for the basic material 8 and/or the finished goods 11.

The drive shafts 9, 10 preferably are supported parallel to one another and driven synchronously. Suitable shaft bearing are accommodated in the gear cases 16, 20. In FIG. 2 the gear case 16 of the drive shaft 9 is merely indicated and the case 20 for the drive shaft 10 is not represented. FIG. 1 shows the gear cases 20. Instead of the closed gear case 20 a plurality of individual gear cases may alternatively be provided. Pursuant to FIG. 2, on the drive shaft 10 sit rotating eccentrics 27, which are constituents of two coupled gears 28 which, in this example, operate as drive means 5 for the performance of the oscillatory motions of the row of guide needles 4. Depending upon the working width of the machine, more or fewer of these coupled gears 28 are arranged to set into motion a normally sized oscillating shaft 29, to which the guide bar 3 is attached by means of holders 30. Thus no increase in diameter of the oscillating shaft 29 is required when the machine is widened.

In addition to a rotating eccentric 27, each coupled gear 28 comprises an annular coupler 31, encompassing the eccentric 27, to which is movably attached a double lever 32 having three articulated shafts and a firmly supported fulcrum 33. The double lever 32 in turn is in articulated connection with an additional coupler 34, to which an intermediate member 35, displaceable lengthwise, is attached, in the continuation of which is provided a drive member 36. A joint 37 is grasped by a rocker arm 38, is frame supported at its other end. The driven member 36 is supported on the oscillating shaft 29 and displaces the guide bar 3 with the row of guide needles 4 in oscillatory motion. The described coupled gear(s) 28 of FIG. 2 correspond to the gear scheme of FIG. 5. In this embodiment the coupled gear 28 represents a dwell linkage. The transmission function of the gear is represented in FIG. 6, where $\rho$ is the angle of rotation of the eccentric 27 and s the path of oscillation of the driven member 36 at a given angle of rotation. Pursuant to FIG. 3, a coupled gear 39 has been provided, in which the coupler 34 and the rocker arm 38 of the coupled gear 28 are omitted. The driven member 36 or the row of guide needles 4 accordingly carry out a sinusoidal course of motion. The diagram of FIG. 4 illustrates this.

Figure 3:
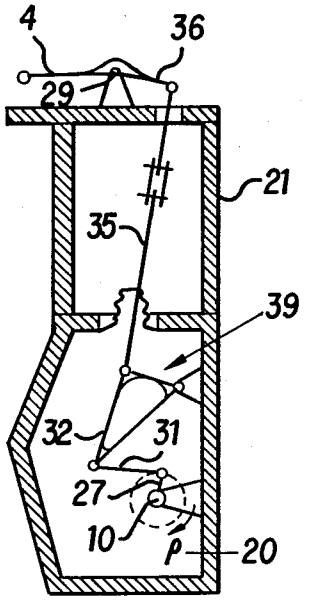
Figure 5:
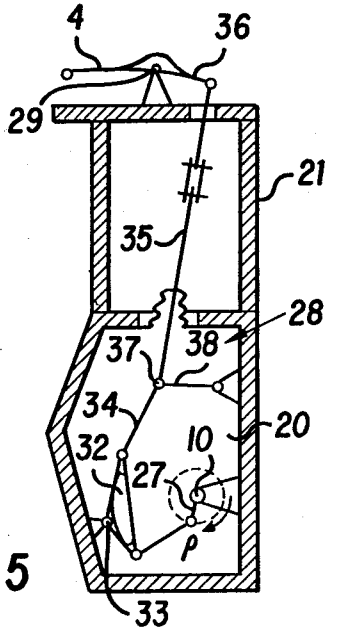
Figure 7:
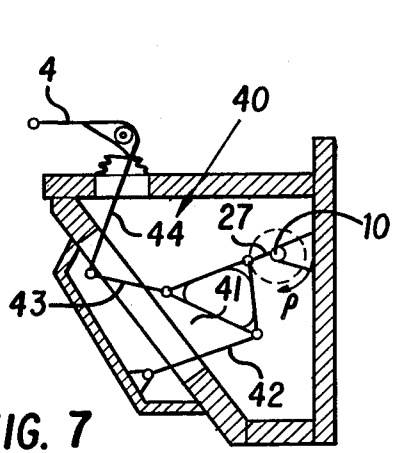
Figure 4:
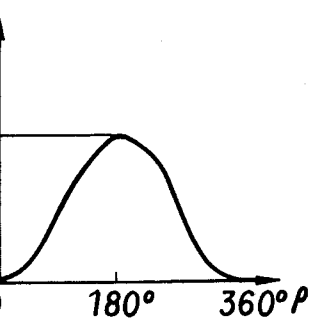
Figure 6:
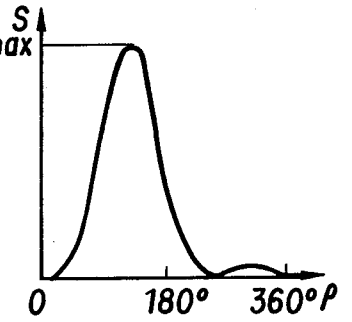
Figure 8:
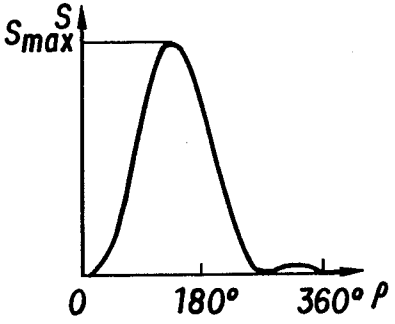

While the drive shaft 10 of FIGS. 3 and 5 was supported in the gear case 20 and the oscillatory motion was to be transmitted through the supporting element 21, according to FIG. 7 the possibility exists of accommodating the drive shaft 10 within the supporting element 21. A coupled gear 40 suitable for this purpose has, on the eccentric or on a crank 27, a triple joint 41 to the second joint of which is coupled a rocker arm 42 and to the third joint of which is linked a coupler 43, where the latter drives a driven member 44 which is designed as a bell-crank lever and jointly comprises the row of guide needles 4. The gear 40 is likewise a dwell linkage. The diagram of FIG. 8 shows the transmission function for this.

We claim:

1. In a warp knitting machine equipped with a row of knitting needles which are movable forward and backward by directly assigned drive means and which have hooks lockable by slides, and in addition comprising at least one guide bar with a row of guide needles which are each likewise connected, for the performance of oscillatory and displacing motions, with directly appurtenant drive means; the drive means of the row of knitting needles and the drive means of the row of guide needles being coupled with the main drive of the machine, the machine being provided over, between and under the rows of needles with a free space for passage of a basic material and the finished goods which extends along the entire length of the rows of needles, so as to be able to feed the basic material undisturbed in the direction over the rows of needles and guide it through between the row of knitting needles and the row of guide needles, as well as to be able to remove the goods, the improvement wherein the drive means for the operation of the row of knitting needles and the drive means for the performance of the oscillatory motions of the row of guide needles are connected to separate drive shafts, the drive shafts having a drive connection with the main drive and each being arranged between the main drive and the appurtenant drive means, the drive shaft for the drive means for the performance of the oscillatory motions of the row of guide needles being located under and/or behind the working plane of the row of knitting needles and before the finished goods, the drive shaft for the drive means for the performance of the oscillatory motions of the row of guide needles having a plurality of drive means distributed across the working width of the machine.

2. A warp knitting machine according to claim 1, wherein the drive connection comprises at least one drive unit by which one drive shaft drives the second drive shaft, and contains an additional drive unit that drive-connects the driving shaft with the main drive.

3. A warp knitting machine according to claim 2, wherein a drive unit is arranged on either side of each of the drive shafts, outside the space for passage of the basic material and/or the finished goods.

4. A warp knitting machine according to claim 2, wherein a toothed belt-bevel gear drive forms the drive unit.

5. A warp knitting machine according to claim 2, wherein the drive unit is a bevel gear drive.

6. A warp knitting machine according to claim 2, wherein a toothed-belt drive is provided as drive unit.

7. A warp knitting machine according to claim 1, wherein the drive shafts are parallel to one another.

8. A warp knitting machine according to claim 2, wherein the drive shafts are provided with at least one drive unit which produces synchronous running of the shafts.

9. A warp knitting machine according to claim 2, wherein the drive shaft for the drive means for the performance of oscillatory motions of the row of guide needles is mounted on the supporting element for seating of the guide bar of the row of guide needles.

10. A warp knitting machine according to claim 1, wherein the drive means comprise coupling gears.

* * * * *